US010274275B1

(12) United States Patent
Terrell

(10) Patent No.: US 10,274,275 B1
(45) Date of Patent: Apr. 30, 2019

(54) FIREARM MAGAZINE SPEEDLOADER

(71) Applicant: Joshua Terrell, League City, TX (US)

(72) Inventor: Joshua Terrell, League City, TX (US)

(73) Assignee: Joshua T. Terrell, League City, TX (US)

( * ) Notice: Subject to any disclaimer, the term of this patent is extended or adjusted under 35 U.S.C. 154(b) by 0 days.

(21) Appl. No.: 16/125,257

(22) Filed: Sep. 7, 2018

Related U.S. Application Data

(60) Provisional application No. 62/609,163, filed on Dec. 21, 2017, provisional application No. 62/607,776, filed on Dec. 19, 2017.

(51) Int. Cl.
*F41A 9/82* (2006.01)
*F41A 9/83* (2006.01)
*F41A 9/67* (2006.01)

(52) U.S. Cl.
CPC .. *F41A 9/83* (2013.01); *F41A 9/67* (2013.01)

(58) Field of Classification Search
CPC ..... F41A 9/82; F41A 9/83
See application file for complete search history.

(56) References Cited

U.S. PATENT DOCUMENTS 578,931 A * 3/1897 Johnson ..... F41A 9/84 42/88
2,783,570 A * 3/1957 Kunz ..... F41A 9/66 42/18
3,789,531 A * 2/1974 Kersten ..... F41A 9/65 206/3
4,574,511 A * 3/1986 Csongor ..... F41A 9/84 42/87
9,772,152 B1 * 9/2017 Niccum ..... F41A 9/83
D815,235 S * 4/2018 Grego ..... D22/108
D829,295 S * 9/2018 Buckner ..... D22/108
2014/0311008 A1 * 10/2014 McPhee ..... F41A 9/84 42/87
2017/0211902 A1 * 7/2017 Mills ..... F41A 9/83

* cited by examiner

*Primary Examiner* — Gabriel J. Klein

(57) ABSTRACT

A gun magazine speedloader with an angled edge suitable for scooping cartridges from a flat surface such as a table. Cartridges enter the body of the speedloader by resting the speedloader onto a flat surface and then sliding the speedloader across the flat surface to scoop up the cartridges proximate to each other. The speedloader is re-oriented into a vertical position and cartridges are gravity fed into the body of the speedloader. The speedloader includes a plunger oriented for plunging cartridges from the body of the speedloader in a direction parallel to the orientation of an affixed magazine. The internal shape of the speedloader is such that cartridges are positioned suitably to fall to the bottom of the speedloader and rest on the plunger tip when rotated to a vertical position. A magazine is then affixed to the speedloader and the plunger is depressed, forcing the cartridges into the magazine.

2 Claims, 10 Drawing Sheets

FIREARM MAGAZINE SPEEDLOADER

CROSS-REFERENCE TO RELATED APPLICATIONS

The present applications claims priority to the earlier filed provisional applications having Ser. No. 62/607,776 filed on Dec. 19, 2017 and 62/609,163 filed on Dec. 22, 2017, and hereby incorporate subject matter of the provisional application in its entirety.

BACKGROUND—PRIOR ART

The following is a tabulation of some prior art that presently appears relevant:

Internet Publications www.cheaperthandirt.com, ProMag AR-15 Five Round Magazine Loader Polymer Black PM017, Item Number MAG-428-085, (May 2018)

U.S. Patents

| Patent No. | Code | Issue Date | Patentee |
|---|---|---|---|
| 4,574,511 | FP | 1984 Jan. 05 | CRAVEN ASSOCIATES Inc. |
| 8,484,874 | FPAY | 2011 Apr. 09 | Battenfeld Technologies, Inc., Missouri |
| US20120192477 | Abandoned | 2011 Jan. 28 | Ray Kim |
| 4,949,495 | FP | 1986 Aug. 06 | Marco Mari |
| 7,059,077 | FPAY | 2001 Sep. 10 | Maglula Ltd |
| 7,805,874 | MAFP | 2007 Jun. 27 | Maglula Ltd |
| 8,356,441 | FP | 2009 Jan. 14 | GEMOPTICS LLC |

BACKGROUND OF THE INVENTION

There are multiple devices and methods intended to simplify the loading of cartridges into a magazine. Modern firearms often are equipped with large capacity magazines. The magazines also utilize spring loaded 'followers' intended to insert cartridges into the firearm magazine. The spring-loaded magazine follower creates resistance when the operator attempts to reload the magazine. The pressure of the spring must be continuously over come during loading. Loading becomes a tedious and irritating task. Additionally, prior devices and methods focused on the problem of loading the magazine but failed to take into consideration the time that could be saved by improving the speed and ease of inserting cartridges into the device itself.

One device intended to simplify loading apparently lies on a flat table and affixes to a magazine. The individual rows of cartridges are sequentially inserted from an open side of the device. See website www.cheaperthandirt.com and item MAG-428-085. This device cannot be operated in a preferable vertical fashion without cartridges being ejected prematurely from the device. Additionally, each cartridge must be manipulated individually to be placed in the device slowing the overall loading time.

One device intended to simplify loading apparently holds packaged cartridges. The individual rows of cartridges are sequentially inserted from an open side of the device using a support pad into the magazine. See U.S. Pat. No. 4,574,511. This device requires the operator to pre-load cartridges onto a support pad prior to loading the magazine. Preloading the support pad is time consuming. Additionally, manipulating the device during the magazine loading operation is cumbersome as the operator must grasp the device and the magazine simultaneously from multiple points.

One device intended to simplify loading apparently holds loose cartridges in a container and a plunger is operated to dispense cartridges into a magazine that is situated parallel to the magazine. See U.S. Pat. No. 8,484,874. This device requires unreasonable dexterity of the operator to transfer cartridges from the device to the firearm magazine as the device does not affix to the magazine. Additionally, the device requires the operator to pre-load rounds into the container singularly which is time consuming. Additionally, the device is bulky and does not allow for easy storage and transportation.

One device intended to simplify loading apparently holds loose cartridges in an open container and a plunger is operated to dispense cartridges into a magazine that is situated parallel to the magazine. See U.S. Patent US20120192477. This device does not temporarily affix to the magazine and requires unreasonable dexterity of the operator to transfer cartridges from the device to the firearm magazine. Additionally, the device requires the operator to pre-load rounds into the device singularly which is time consuming. Additionally, the non-contained cartridges have the potential to be ejected from the device during the loading operation. Additionally, manipulating the device during the magazine loading operation is cumbersome as the operator must grasp the device and the magazine simultaneously from multiple points.

One device intended to simplify loading apparently requires the use of an electric motor that operates a piston to dispense cartridges from an attached track into a temporarily affixed magazine. See U.S. Pat. No. 4,949,495. This device is large and not easily portable. Additionally, the device requires an electric power source to operate. Additionally, the device requires the operator to pre-load rounds into the device individually along a fixed track which is time consuming.

One device intended to simplify loading apparently holds loose cartridges along a fixed track and a slider is operated to dispense cartridges into a magazine that is temporarily set into the device. See U.S. Pat. No. 7,059,077. This device requires the operator to pre-load rounds into the device individually which is time consuming. Additionally, the non-contained cartridges have the potential to be ejected from the device during the loading operation. Additionally, the device is large and not easily portable.

One device intended to simplify loading apparently holds loose cartridges along a stripper clip and a slider to dispense cartridges into a magazine. See U.S. Pat. No. 7,805,874. This device requires the operator to pre-load cartridges individually onto striper clips prior to operating the device which is time consuming. Additionally, the non-contained cartridges have the potential to be ejected from the device during the loading operation.

One device intended to simplify loading apparently holds loose cartridges in a well and a mechanical operation loads the cartridges into a temporarily affixed magazine. See U.S. Pat. No. 8,356,441. This device requires multiple movements by the operator to completely fill a magazine. Additionally, this device requires the operator to pre-load rounds into the device individually which is time consuming. Additionally, this device is comprised of multiple parts that increase the likelihood of a mechanical failure.

SUMMARY

In accordance with one embodiment, a speedloader comprises a hollow body suitable on one end to affixing to the loading end of a firearm magazine and a plunger on the opposite end of the speedloader. When the plunger is compressed cartridges are forced into the firearm magazine.

Advantages

Accordingly several advantages of one or more aspects are as follows: to allow scooping of multiple cartridges from a flat surface into the speedloader prior to magazine loading, that is compact for easy storage in range bags, that can be handled without the plunger falling out of the speedloader body when operating, that is shaped to allow cartridges to easily fall into the proper alignment prior to magazine loading, and that can be manufactured with surfaces suitable for holding designs. Other advantages of one or more aspects will be apparent from a consideration of the drawings and ensuing description.

DRAWINGS—FIGURES

Figure 1:
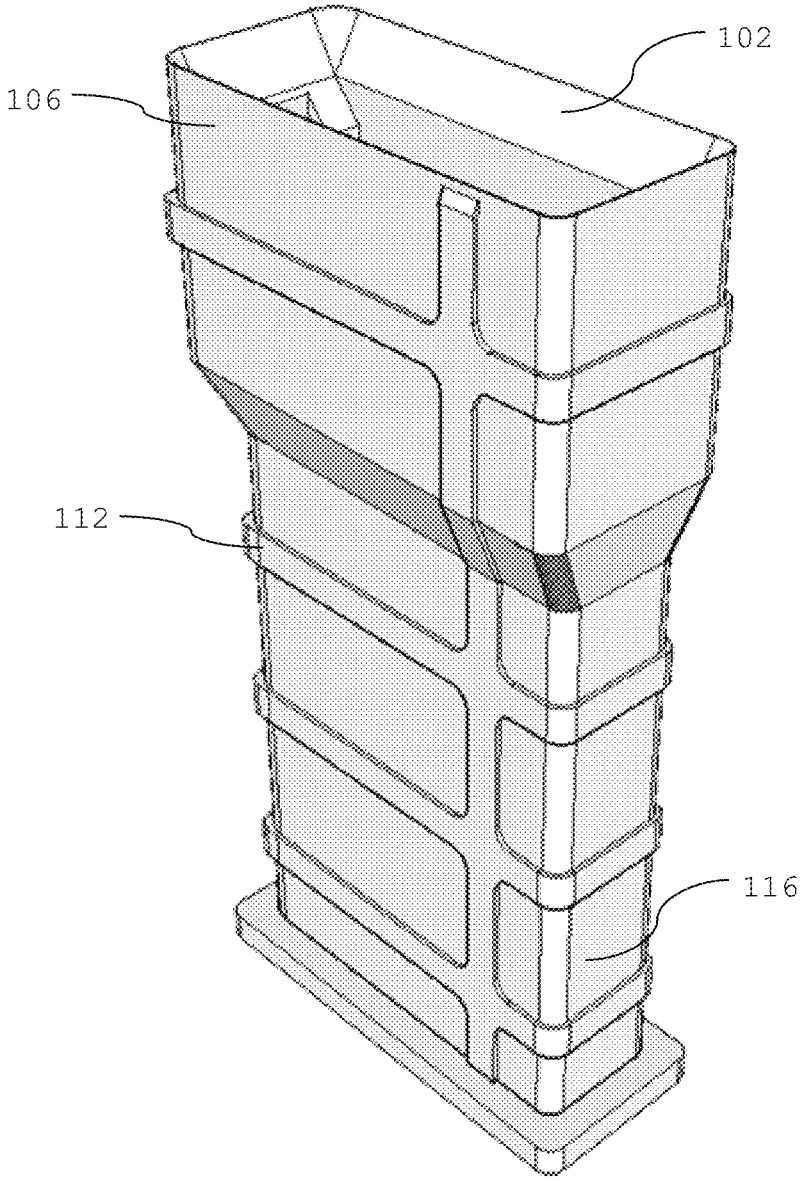
FIG. 1 shows the exterior of an embodiment of a speedloader with a beveled top edge and a plunger that is not extended.

| DRAWINGS REFERENCE NUMERALS |
|---|
| 102 - Beveled Edge |
| 106 - SpeedLoader Body Top |
| 112 - Artistic Decoration |
| 116 - SpeedLoader Body Bottom |
| 202 - Plunger Shaft |
| 204 - Plunger Base |
| 302 - Plunger Wing (Cartridge Tip Side) |
| 304 - Plunger Wing (Depressor Side) |
| 306 - Plunger Tip (Convex Embodiment) |
| 402 - Falling Edge |
| 404 - Magazine Resting Plane |
| 408 - Magazine Guide Channel |
| 410 - Angled Depressor Block |
| 412 - Angled Depressor Block Notched Corner |
| 502 - Offset Edge |
| 508 - Raised Cartridge Tip Resting Plane |
| 604 - Speedloader Foot |

-continued

| DRAWINGS REFERENCE NUMERALS |
|---|
| 702 - Swing Arm |
| 704 - Side Wing |
| 706 - Depressor Block |
| 802 - Cartridge |
| 902 - Magazine |

DETAILED DESCRIPTIONS OF SPECIFIC EMBODIMENTS

Figure 2:
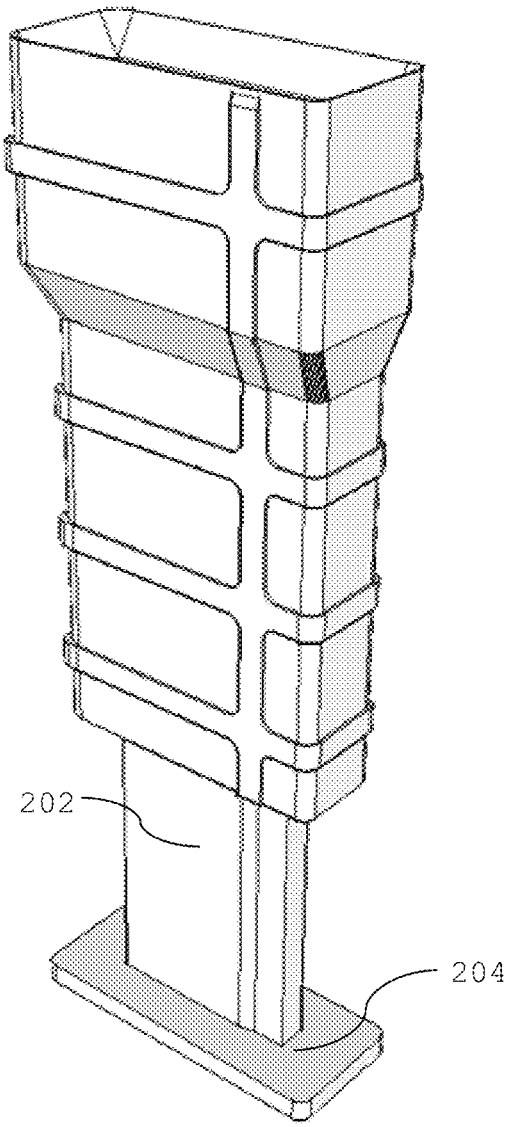
FIG. 2 shows the exterior of an embodiment of a speedloader with the plunger extended demonstrating the movement of the plunger relative to the body.

FIG. 1 shows a perspective view of one embodiment of the speedloader. The disclosure illustrates a device that allows properly dimensioned cartridges to be inserted into a hollow component of a speedloader. The speedloader comprises a three dimensional rectangular structure. The structure acts as a cartridge holder. The structure also includes a plunger mechanism extending into the hollow structure through an open bottom end as shown in FIG. 2. The plunger tip 306 serves as the bottom surface holding a cartridge. Additional cartridges are held on top of this bottom cartridge. The cartridges are vertically aligned by the conforming or complementary sides and ends of the hollow component. The plunger can push the cartridges out of the hollow structure through an open top end. The cartridges can be pushed into a magazine.

The hollow component of the speedloader can be shaped to complement the shape and dimensions of the specific cartridges. The cartridges must obviously be dimensioned to be compatible or operable with the firearm. The shape and dimensions of the speedloader interior prevent an incorrect cartridge being inserted into a firearm. Incorrect sizing could result in injury or damage.

The shape and dimensions of the hollow interior component of the speedloader cause each cartridge to be correctly oriented within the apparatus. When the cartridges are pushed by the plunger into the magazine, the cartridges are correctly oriented to the interior of the magazine.

The apparatus has an open top. At least one edge 102 that comprises the open top may be slanted or beveled. This allows the apparatus to be placed on a flat surface and loose cartridges can be scooped or pushed into the hollow interior component of the speedloader.

The loader apparatus can also be filled by inserting individual cartridges through the open top. The apparatus does not contain a spring. Therefor the apparatus can be easily filled as there is no spring pressure to overcome.

Figure 4:
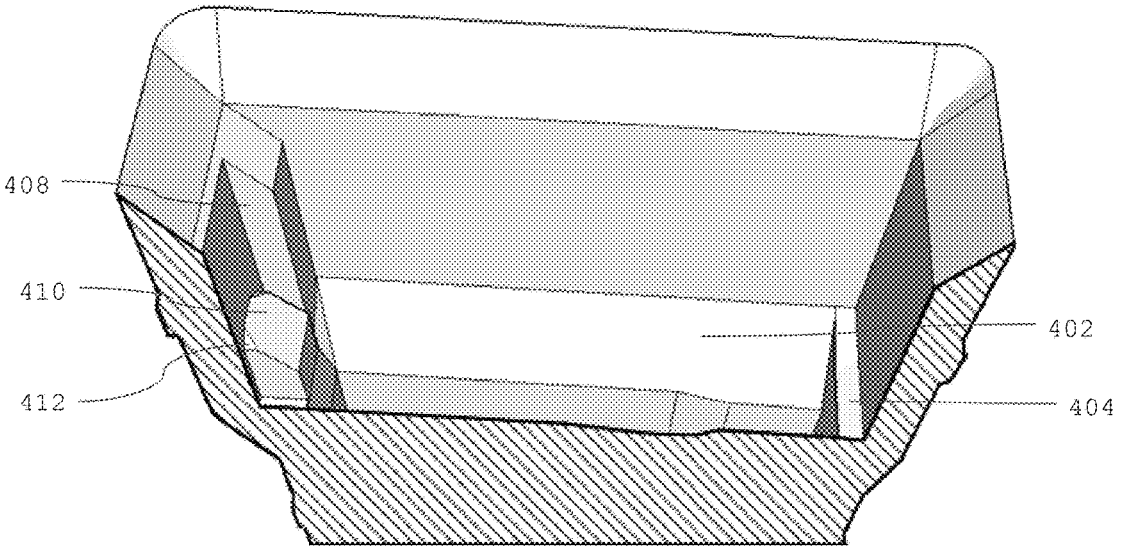
FIG. 4 shows a cut-away view of the upper portion of an embodiment of a speedloader body detailing the Falling Edge and the Angled Depressor Block.
Figure 10:
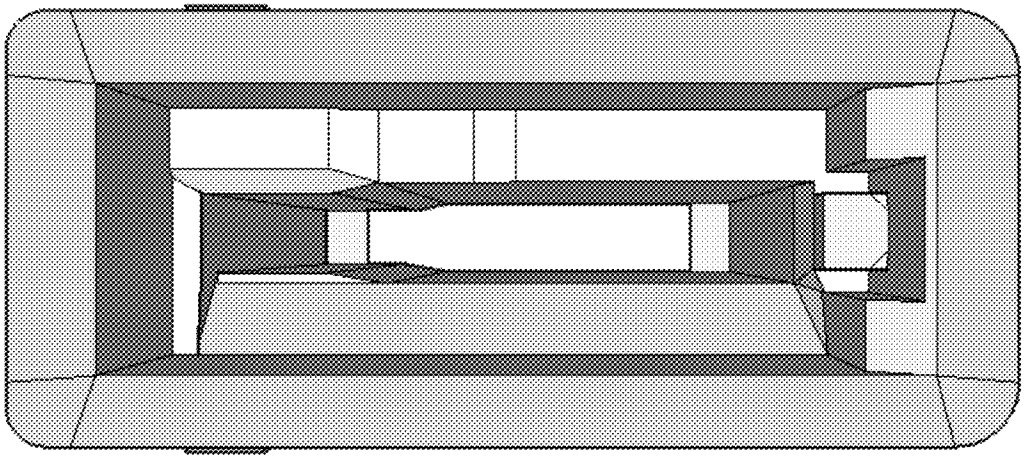
FIG. 10 shows the exterior of an embodiment of a speedloader from a top view with the plunger removed.

The open top of the speedloader body is shown in a cutaway view in FIG. 4. The interior of the apparatus has a depressor block 410. The depressor block 410 pushes the magazine follower into the magazine body when the magazine is inserted into the speedloader as seen in FIG. 10.

When inserting cartridges into the speedloader body while in a vertical position, the cartridges will come into contact with various features of the interior of the upper portion of the speedloader as they fall into the lower portion of the speedloader. For the speedloader to function properly, the cartridges must be aligned horizontally. If any cartridge is oriented in a vertical position the speedloader will not push cartridges into the magazine when loading. Cartridges are often re-oriented from a horizontal position to a vertical position when they come into contact with the depressor block when entering the speedloader. This is an undesirable effect.

The Angled Depressor Block 410 is shaped such that when inserting cartridges into the speedloader, the cartridges will slide forward and remain in a horizontal position rather than tipping forward to a vertical position.

Figure 7:
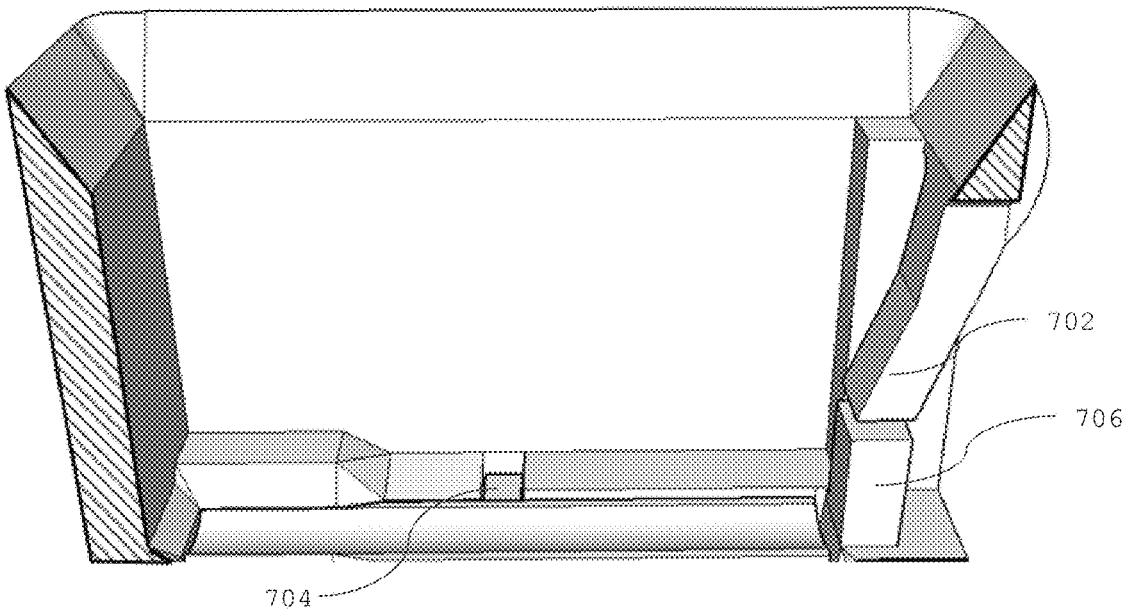
FIG. 7 shows an embodiment of a speedloader incorporating features such as a Swing Arm, Side Wings and a Depressor Block.

Alternate embodiments of the speedloader include additional structures in the speedloader interior to minimize contact between the depressor block and cartridges when inserting cartridges into the speedloader. Such features include but are not limited to a swing arm 702 as shown in FIG. 7. The swing arm is a structure that slides cartridges away from the depressor block 706 while maintaining the cartridge in a horizontal position when inserting cartridges into the speedloader. When a magazine is inserted into the upper portion of the speedloader the swing arm is repositioned, giving enough clearance for the magazine to be fully inserted into the speedloader. The swing arm may be hinged or may rely on the flexibility of the material comprising the swing arm.

Figure 5:
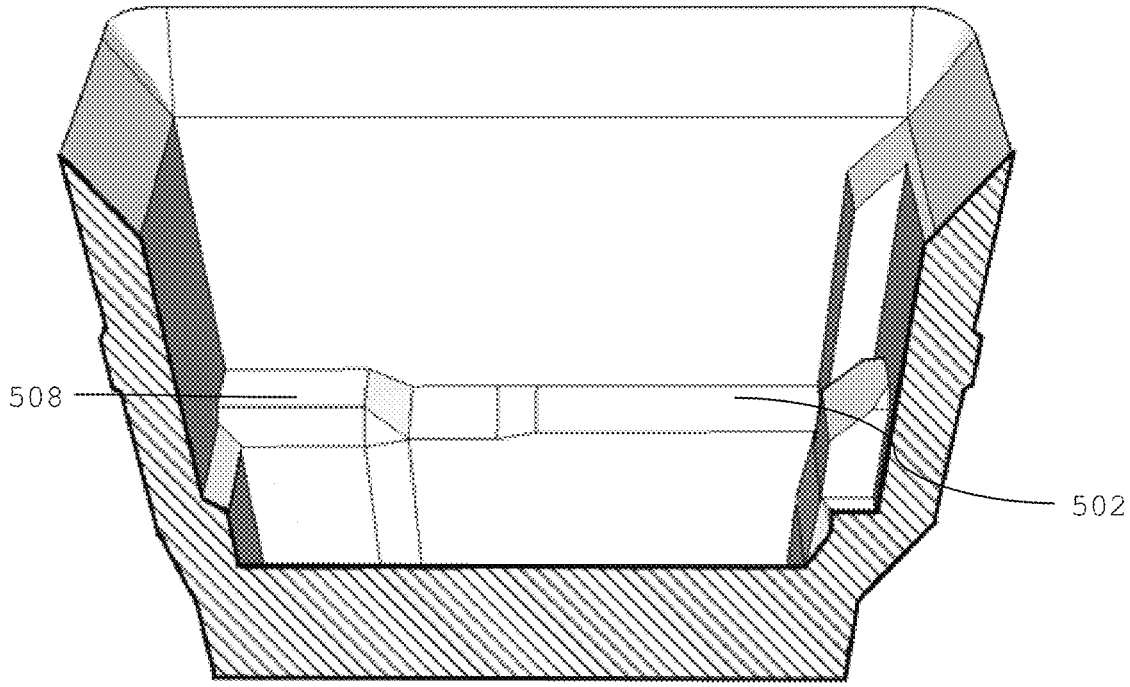
FIG. 5 shows a cut-away view of the upper portion of the speedloader body detailing the Offset Edge.
Figure 6:
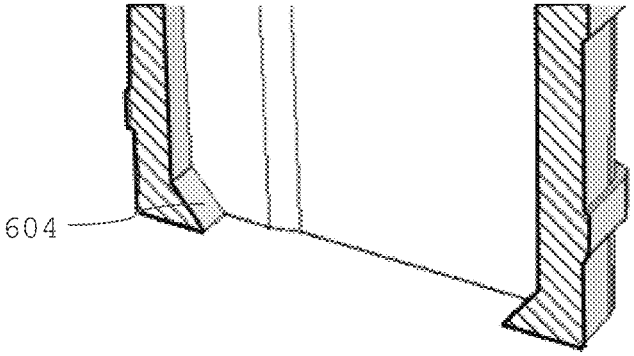
FIG. 6 shows a cut-away view of an embodiment of a speedloader with the lower portion of the speedloader body, detailing the feet at the base of the speedloader body interior.
Figure 8:
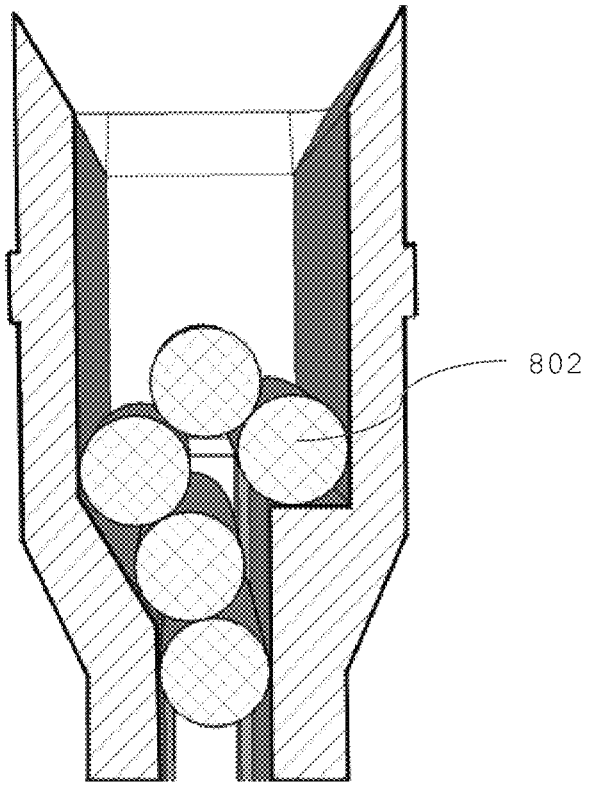
FIG. 8 shows a cut-away view of an embodiment of a speedloader body detailing how the cartridges interact with internal structures such as the Offset Edge and the Falling Edge as the cartridges are inserted into the speedloader.
Figure 9:
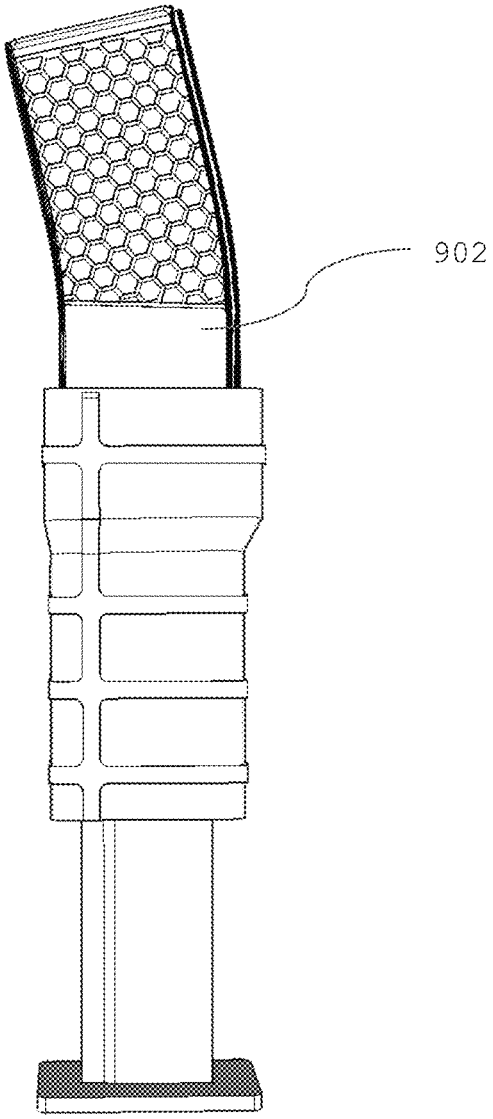
FIG. 9 shows the exterior of an embodiment of a speedloader with a plunger that is extended and with a magazine inserted for loading.

When inserting cartridges into the speedloader the cartridges will also come into contact with other cartridges as they fall into the lower portion of the speedloader as seen in FIG. 8. The Falling Edge 402 as shown in FIG. 4 and the Offset Edge 502 as shown in FIG. 5 are shaped to allow the cartridges to fall to the bottom of the speedloader.

As shown in FIG. 8, the Falling Edge 402 is sharply angled downward giving cartridges proper clearance to slide into the center of the speedloader body when inserting cartridges into the speedloader.

As shown in FIG. 8, the Offset Edge 502 is very slightly angled downward and acts as a shelf. Cartridges that come into contact with the Offset Edge 502 do not initially fall down into the lower portion of the speedloader body and are held in a higher position than cartridges contacting the Falling Edge 402. These two edges (Falling Edge 402 and Offset Edge 502) force cartridges to align in single file horizontal orientation when inserting cartridges into the speedloader. In alternate embodiments the Offset Edge is not angled at all.

Figure 3:
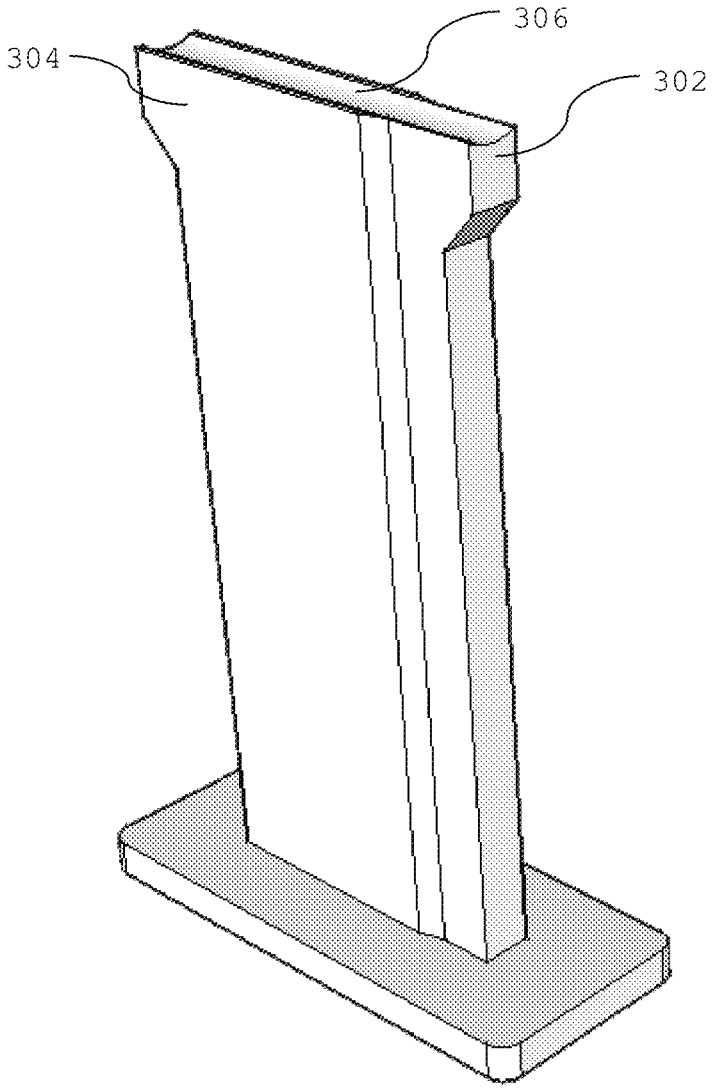
FIG. 3 shows the exterior of an embodiment of a speedloader with a plunger removed from the speedloader body to illustrate its size and shape.

FIG. 3 shows a perspective view of the plunger separate from the speedloader. The speedloader plunger consists of a straight shaft 202 attached to a rectangular base 204. The shape of the shaft conforms to the dimensions of the cartridge being loaded.

The speedloader plunger also consists of plunger wings 304 near the top of the plunger that comes into contact with the speedloader feet 602 when fully extended to prevent removal. This assists when manipulating the speedloader while adding cartridges.

Advantages

From the description above, a number of advantages of some of embodiments of my firearm magazine speedloader become evident:

(a) One can load manipulate the speedloader with a single hand while inserting cartridges easily with the other hand.

(b) Cartridges can be inserted into the speedloader by scooping cartridges from a table or flat surface.

(c) Cartridges assume proper positioning for loading when the speedloader is rotated into an upright position.

(d) The compact size allows for easy transportation in standard sized range bags.

(e) Operating the speedloader in a vertical position allows the least amount of effort to load the magazine.

(f) The flat outer surface provides suitable spacing for labeling.

CONCLUSION, RAMIFICATIONS, AND SCOPE

Accordingly, the reader will see that the various embodiments allow for a depressor block that depresses the magazine follower when the magazine is inserted into the speedloader. By depressing the magazine follower, cartridges are given proper clearance to enter the magazine when loading. In addition, when inserting cartridges into the speedloader the cartridges are easily oriented in a manner within the speedloader body ready for loading into the magazine.

Furthermore, the speedloader has the additional advantages in that:

it permits the operator to use a single hand to grasp the speedloader while inserting cartridges into the speedloader body with the alternate hand;

it permits cartridges to be inserted into the speedloader body by scooping the cartridges up from a table or other flat surface;

it permits cartridges to orient themselves optimally (horizontally) when inserting multiple cartridges into the speedloader body at once;

it provides a compact overall size for easier storage in a range bag;

it permits operation of the device in a vertical fashion during the loading process allowing for the least amount of physical exertion; and it provides a flat outer surface upon which one can affix a label.

Although the description above contains many specificities, these should not be construed as limiting the scope of the embodiments but as merely providing illustrations of some of several embodiments. For example, the speedloader can have other shapes, such as circular, oval, trapezoidal, triangular, etc.; the swing arm can have multiple shapes or be replaced by a hinged version; and the depressor block may have alternate shapes such as squared, notched, v-shaped, rounded, etc.

Thus the scope of the embodiments should be determined by the appended claims and their legal equivalents, rather than by the examples given.

I claim:

1. A firearm magazine loading device, comprising:

a) a hollow body configured to contain cartridges;

b) an end of said body configured to affix to a loading end of a firearm magazine;

c) the hollow body having an interior beveled edge configured to scoop multiple cartridges into said device from a flat surface, and d) a plunger having at least a portion slideably engaged within the hollow body and configured to load cartridges into the firearm magazine when depressed.

2. A method for inserting cartridges into a firearm magazine loading device, comprising:

a) providing the firearm magazine loading device of claim 1;

b) sliding said device across a flat surface;

c) scooping cartridges into said device via the interior beveled edge; and d) rotating the device to a vertical position, allowing said cartridges to be gravity fed into the device while simultaneously being properly positioned for a subsequent magazine loading process.

* * * * *